United States Patent [19]

Miyata et al.

[11] Patent Number: 4,732,121

[45] Date of Patent: Mar. 22, 1988

[54] RECOIL STARTER

[75] Inventors: Hiromasa Miyata; Toshio Taomo, both of Tokyo; Akira Nagashima, Kawasaki, all of Japan

[73] Assignee: Kioritz Corporation, Tokyo, Japan

[21] Appl. No.: 25,726

[22] Filed: Mar. 13, 1987

[30] Foreign Application Priority Data

Mar. 24, 1986 [JP] Japan ..... 61-42737[U]

[51] Int. Cl.[4] ..... F02N 3/02

[52] U.S. Cl. ..... 123/185 BA; 185/45; 267/156

[58] Field of Search ..... 123/185 B, 185 BA; 185/39, 45; 267/156

[56] References Cited

U.S. PATENT DOCUMENTS

| | | | |
|---|---|---|---|
| 3,782,355 | 1/1974 | Hamman | 123/185 B |
| 4,261,437 | 4/1981 | Zavatkay et al. | 123/185 BA |
| 4,480,605 | 11/1984 | Bloemers | 123/185 B |

*Primary Examiner*—Andrew M. Dolinar

*Attorney, Agent, or Firm*—Browdy and Neimark

[57] ABSTRACT

A recoil starter is disclosed which comprises a cup-shaped casing, a side plate integrally having an annular projection disposed in opposition to an inside of a bottom portion of the casing and having an engagement hole to be engated with an engagement projection of the bottom portion, and a spiral spring retained at one end to the annular projection of the side plate and kept in place in a spiral form within a circumferential wall of the side plate. The side plate integrally has the circumferential wall and a boss portion insertion hole at its central portion.

2 Claims, 3 Drawing Figures

RECOIL STARTER

BACKGROUND OF THE INVENTION

1. Field of the Invention

The present invention relates to a recoil starter for use in internal combustion engines or the like as power source for power equipments or outboard motorboats.

2. Description of the Prior Art

A typical conventional recoil starter is shown in FIG. 3. In the arrangement shown, a spiral spring 2 is interposed within a casing 1 one side of which is opened. The spiral spring 2 is retained at one end to the casing 1 with its opposite side portions being supported by side plates 4 and 5. Thus, the spiral spring 2 is kept in place by the casing 1 and the side plates 4 and 5. A drum 7 is rotatably mounted on a center boss 6 of the casing 1 so that the drum 7 is located outside of the side plate 5. At the same time, the other end of the spiral spring 2 is retained at the drum 7. The drum 7 is prevented from moving axially outwardly away from the center boss 6 of the casing 1 by means of a washer 9 and a screw 8 threadedly inserted into the center boss 6 of the casing 1. A rope 11 is wound in a spiral form within a circumferential groove 10 that is opened radially outwardly of the drum 7. An inner end of the rope 11 is fixed to the drum 7. A coupling portion 13 formed on an annular boss 12 of the drum 7 is adapted to be detachably coupled to a crankshaft or the like of an internal combustion engine.

In such a conventional arrangement, when the drum 7 is removed apart from the casing 1 in the case where the recoil rope 11 is worn out or cut, the end of the spiral spring 2 retained to the drum 7 will move axially outwardly. As a result, the spiral spring 2 is spread at once due to its resiliency. This would make it difficult to assemble or disassemble the recoil starter. Also, the retaining portion of the casing 1 for retaining the other end of the spiral spring 2 is likely to be worn out, which would shortens a service life of the recoil starter.

SUMMARY OF THE INVENTION

Accordingly, in order to overcome the above-noted defects inherent in the conventional recoil starter, an object of the present invention is to provide a recoil starter which is simple in structure and easy to manufacture.

To this end, according to the present invention, there is provided a recoil starter which comprises a cup-shaped casing having a circumferential wall portion and a bottom portion integrally formed with a drum mounting boss portion and an engagement projection which are directed axially inwardly, a side plate integrally having an annular projection disposed in opposition to an inside of the bottom portion of the casing and having an engagement hole to be engaged with the engagement projection of the bottom portion, said side plate also having an integral circumferential wall along its circumference and a boss portion insertion hole at its central portion, and a spiral spring retained at one end to the annular projection of the side plate and kept in place in a spiral form within the circumferential wall of the side plate.

According to the arrangement of the invention, it is possible to attach the spiral spring together with the side plate after the spiral spring has been disposed within the side plate. Also, when the drum is removed away from the casing, the side plate is left engaged with the casing to ensure a positive retention of the spiral spring within the side plate while preventing the spiral spring from displacing or shifting from the side plate. Furthermore, it is possible to effectively prevent an undesirable entrainment of foreign matters into the spiral spring receiving portion. Also, according to the present invention, the spiral spring is retained at one end to the annular projection of the side plate and received in a spiral form within the circumferential wall portion of the side plate, and the conventional spiral spring and support plates are formed into a unit. This makes it easy to assemble or disassemble the recoil device. Also, the side plate is engaged with the casing, there is no fear that the spiral spring would be displaced during the disassembling work. The maintenance and inspection of the recoil starter are facilitated. The entrainment of the foreign matters is effectively prevented. Therefore, it is possible to ensure a smooth operation for a long period of time. Also, the number of necessary mechanical parts may be reduced and the structure may be simplified for low cost manufacturing.

DESCRIPTION OF THE PREFERRED EMBODIMENT

The present invention will now be described by way of example with reference to the accompanying drawings.

Figure 1:
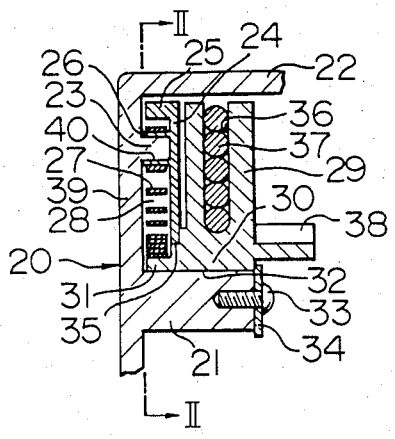
FIG. 1 is a fragmentary, side elevational sectional view showing a recoil starter in accordance with one embodiment of the present invention.
Figure 3:
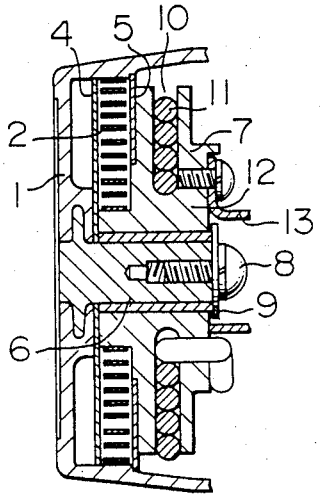
FIG. 3 is a side elevational sectional view showing a conventional recoil starter.
Figure 2:
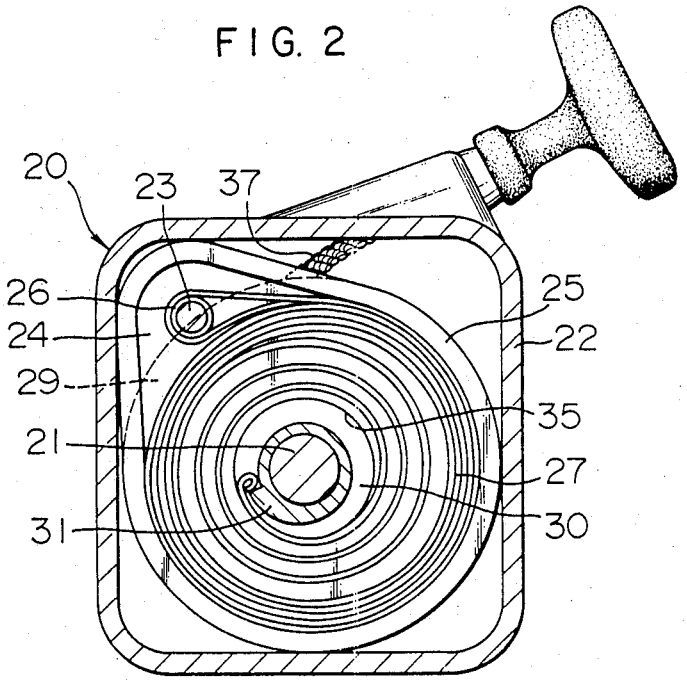
PRIOR ART FIG. 2
FIG. 2 is a cross-sectional view taken along the line II—II of FIG. 1.

A recoil starter in accordance with one embodiment of the invention is shown in FIGS. 1 and 2, which recoil starter comprises a cup-shaped casing 20 opened on one side. A drum mounting boss portion 21 is integrally formed at a central portion of a bottom portion 39 of the casing 20, and an engagement projection 23 is also integrally formed in the vicinity of a circumferential wall 22 of the casing 20. The drum mounting boss portion 21 and the engagement projection 23 extend axially inwardly to confront the inside of the casing 20. A side plate 24 is arranged in opposition to the bottom portion 39 within the casing 20. The side plate 24 has an integral wall portion 25 for retaining a spring 27. The wall portion 25 extends along all or part of the circumference of the side plate 24. The wall portion 25 is engaged with the inside of the circumferential wall portion 22 of the casing 20. Furthermore, an annular projection 26 that has therein an engagement hole 40 is integrally formed with the side plate 24. The engagement projection 23 of the casing 20 is engaged with and positioned in the engagement hole 40 of the annular projection 26.

The recoil spiral spring 27 is retained at one end to the outer periphery of the annular projection 26 of the side plate 24 and is wound in a spiral form within the circumferential wall 25 of the side plate 24. The other end of the spiral spring 27 is retained at a front end 31 of a boss portion 30 of a recoil rope drum 29 that is inserted into a boss portion insertion hole 35 formed at a central portion of the side plate 24.

The drum 29 is rotatably supported to the casing 20 while a central hole 32 formed in the boss portion 30 is being engaged with the drum mounting boss portion 21 of the casing 20. The drum 29 is prevented from moving axially outwardly through a washer 34 by means of a screw 33 that is threadedly inserted into a tip end of the drum mounting boss portion 21 of the casing 20. The front end portion 31 of the boss portion 30 of the drum 29 is inserted into the boss portion insertion hole 35 of the side plate 24 with a small clearance. The drum 29 has a deep circumferential groove 36 opened radially outwardly. A recoil rope 37 is wound in a spiral form within the circumferential groove 36. The inner end of the rope 37 is fixed to the drum 29. Furthermore, coupling claws 38 are integrally formed on an outer peripheral surface of the drum 29. The coupling claws 38 are to be detachably coupled to a crankshaft or the like of the internal combustion engine (not shown).

We claim:

1. A recoil starter comprising:

a cup-shaped casing having a circumferential wall portion and a bottom portion integrally having a drum mounting boss portion and an engagement projection which are directed axially inwardly;

a side plate integrally having an annular projection disposed in opposition to an inside of said bottom portion of said casing and an engagement hole to be engaged with said engagement projection of said bottom portion, said side plate integrally having a circumferential wall along its circumference and a boss portion insertion hole at its central portion; and a spiral spring retained at one end to said annular projection of said side plate and kept in place in a spiral form within said circumferential wall of said side plate.

2. The recoil starter according to claim 1, further comprising a drum on said drum mounting boss portion, coupling claws adapted to be detachably coupled to a crankshaft or the like of an internal combination engine, said coupling claws being formed integrally on an outer surface of said drum.

* * * * *